US007143477B2

(12) United States Patent
Dalsing et al.

(10) Patent No.: US 7,143,477 B2
(45) Date of Patent: Dec. 5, 2006

(54) TUBULAR KNOB CATCH ASSEMBLY

(75) Inventors: Troy A. Dalsing, Calhan, CO (US); Ernest Kelso, Fountain, CO (US)

(73) Assignee: Schlage Lock Company, Indianapolis, IN (US)

( * ) Notice: Subject to any disclaimer, the term of this patent is extended or adjusted under 35 U.S.C. 154(b) by 0 days.

(21) Appl. No.: 10/839,110

(22) Filed: May 5, 2004

(65) Prior Publication Data

US 2005/0246866 A1 Nov. 10, 2005

(51) Int. Cl.
*A45C 3/00* (2006.01)

(52) U.S. Cl. ..... 16/412; 292/336.3

(58) Field of Classification Search ..... 16/412, 16/414, 422, 433, 436, DIG. 41; 292/336.3, 292/347, 348, 353, 359, DIG. 31, DIG. 49, 292/DIG. 53; 70/91, 207, 224, DIG. 31
See application file for complete search history.

(56) References Cited

U.S. PATENT DOCUMENTS 2,660,466 A 11/1953 Cerf, Jr.
3,337,254 A 8/1967 Russell et al.
5,476,295 A * 12/1995 Smallegan et al. ..... 292/336.3
5,941,108 A * 8/1999 Shen ..... 70/467
5,947,537 A * 9/1999 Aigner et al. ..... 292/352
6,099,053 A * 8/2000 Huang ..... 292/336.3
6,533,336 B1 * 3/2003 Kemp et al. ..... 292/348
6,575,503 B1 * 6/2003 Johansson et al. ..... 292/170
6,601,270 B1 * 8/2003 Eckhardt et al. ..... 16/412
6,695,365 B1 * 2/2004 Chong et al. ..... 292/348
2003/0033690 A1 * 2/2003 Lin ..... 16/412
2004/0123427 A1 * 7/2004 Lee ..... 16/412

* cited by examiner

*Primary Examiner*—Robert J. Sandy
*Assistant Examiner*—Andre' L. Jackson
(74) *Attorney, Agent, or Firm*—Michael Best & Friedrich LLP

(57) ABSTRACT

A handle catch retainer is preferably for a door handle assembly including a support member coupled with the door and a handle disposed about the support member, the catch being configured to couple the handle and support member. The retainer includes a tubular base disposeable within the support member and an elongated holder connected with the base. The holder is configured to support the catch and is moveable between first and second positions with respect to the base, such that the catch is engageable with the handle when the holder is at the first position and the catch is nonengageable with the handle when the holder is at the second position. Further, the retainer is configured so that the holder is generally biased toward the first position. Preferably, the holder is integrally connected with the base such that the holder is biased to the first position by material forces.

17 Claims, 7 Drawing Sheets

TUBULAR KNOB CATCH ASSEMBLY

BACKGROUND OF THE INVENTION

The present invention relates to handle assemblies, and more particularly to the handle catches of such handle assemblies.

Certain handle assemblies include a handle connected with an inner member, such as a spindle or dummy spindle, by means of a catch. As shown in FIGS. 1 and 2, one device for movably connecting the catch C with the inner member M is by means of an elongated flexible retainer R having one end inserted into one or more connective portions P of the inner member M and another end connected with the catch C. Although such structures generally serve the purpose of movably retaining the catch C, these components are relatively difficult to assemble, and therefor increase the time and cost of manufacturing handle assemblies having such retainer devices.

SUMMARY OF THE INVENTION

In one aspect, the present invention is a handle catch retainer for a door handle assembly that includes an inner support member coupled with the door and a handle disposed at least partially about the support member, the catch being configured to couple the handle with the support member. The retainer comprises a base disposeable within the support member and a holder connected with the base. The holder is configured to support the catch and is moveable between first and second positions with respect to the base. As such, when the base is disposed within the support member with the catch supported by the holder and the handle disposed about the support member, the catch is engageable with the handle when the holder is at the first position and the catch is nonengageable with the handle when the holder is at the second position. Further, the retainer is configured such that the holder is generally biased toward the first position.

In another aspect, the present invention is also a handle catch retainer for a door handle assembly as discussed above. The retainer comprises a generally tubular body disposeable within the support member and having a portion providing a holder configured to support the catch. The holder is movable between a first position at which the catch is engageable with the handle and a second position at which the catch is nonengageable with the handle. The retainer is configured such that the holder is generally biased toward the first position.

In a further aspect, the present invention is a handle assembly for a door. The handle assembly comprises a support member coupled with the door, a handle disposed at least partially about the support member, and a catch configured to couple the knob with the support member. A catch retainer includes a base disposeable within the support member and a holder connected with the base and configured to support the catch. The holder is movable between a first position at which the catch is engageable with the knob and a second position at which the catch is nonengageable with the knob. Further, the retainer is configured such that the holder biases the catch toward the first position.

In yet another aspect, the present invention is again a handle catch retainer for handle assembly as generally discussed above. The retainer comprises a base disposeable within the inner body and a holder integrally formed with the base. The holder is configured to support the catch and is movable between a first position at which the catch is engageable with the handle and a second position at which the catch is nonengageable with the handle. The retainer is configured such that the holder is generally biased toward the first position.

BRIEF DESCRIPTION OF THE SEVERAL VIEWS OF THE DRAWINGS

The foregoing summary, as well as the detailed description of the preferred embodiments of the present invention, will be better understood when read in conjunction with the appended drawings. For the purpose of illustrating the invention, there is shown in the drawings, which are diagrammatic, embodiments that are presently preferred. It should be understood, however, that the present invention is not limited to the precise arrangements and instrumentalities shown. In the drawings.

DETAILED DESCRIPTION OF THE INVENTION

Certain terminology is used in the following description for convenience only and is not limiting. The words "inner", "inwardly" and "outer", "outwardly" refer to directions toward and away from, respectively, a designated centerline or a geometric center of an element being described, the particular meaning being readily apparent from the context of the description. As used herein, the word "handle" is intended to refer to any device that is manually manipulable or graspable by a user and used to initiate movement of another device (e.g., door, drawer, etc.) coupled therewith, and includes but is not limited to devices such as levers, knobs, pushbars, pull rings, thumb turns, and all other similar devices. Further, as used herein, the word "connected" is intended to include direct connections between two members without any other members interposed therebetween and indirect connections between members in which one or more other members are interposed therebetween. The terminology includes the words specifically mentioned above, derivatives thereof, and words or similar import.

Figure 5:
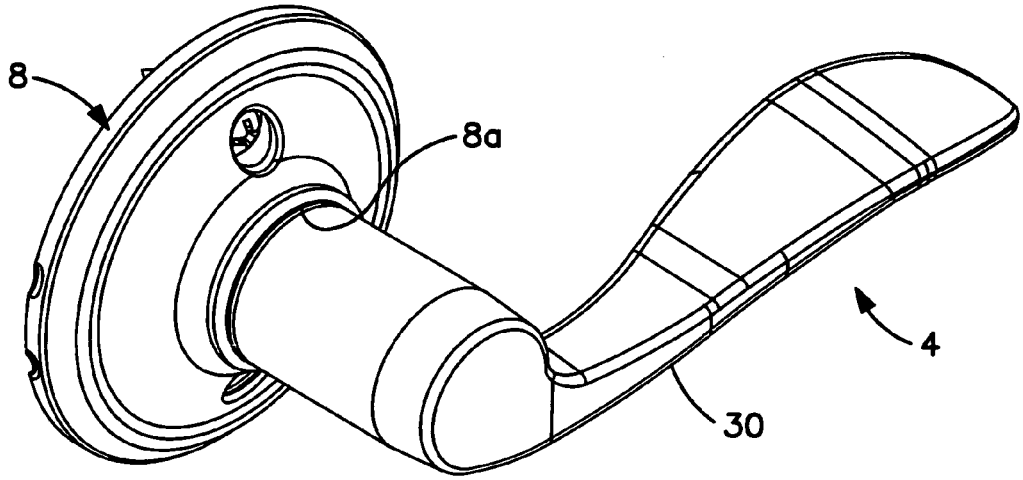
FIG. 5 is a perspective view of a handle assembly incorporating the handle catch retainer.
Figure 6:
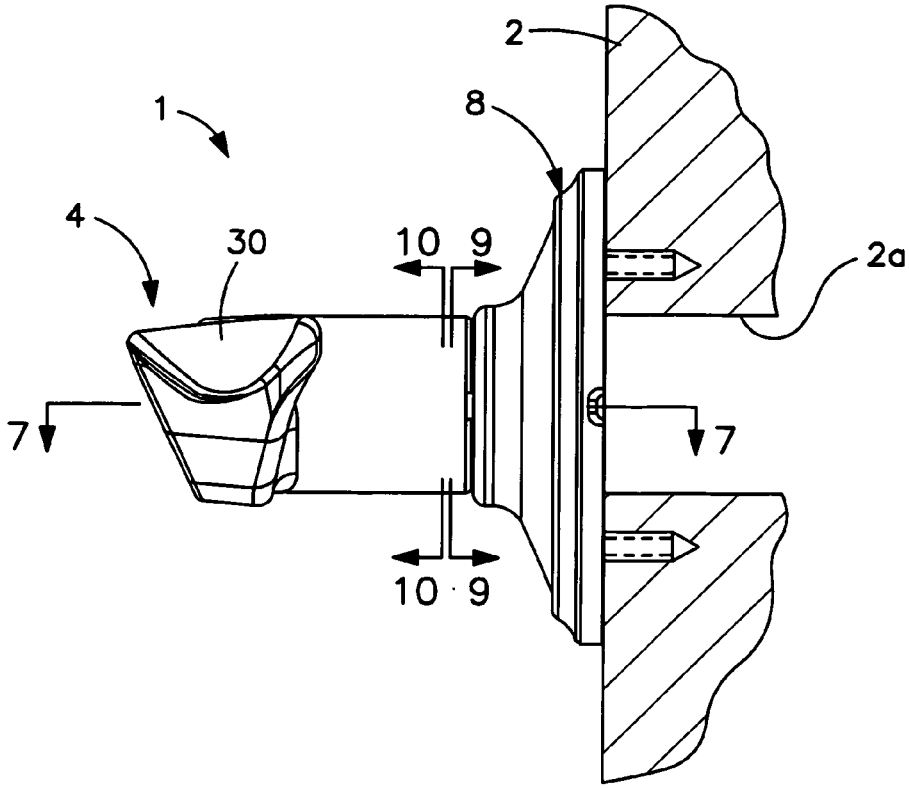
FIG. 6 is a side view of the handle assembly of FIG. 5.
Figure 7:
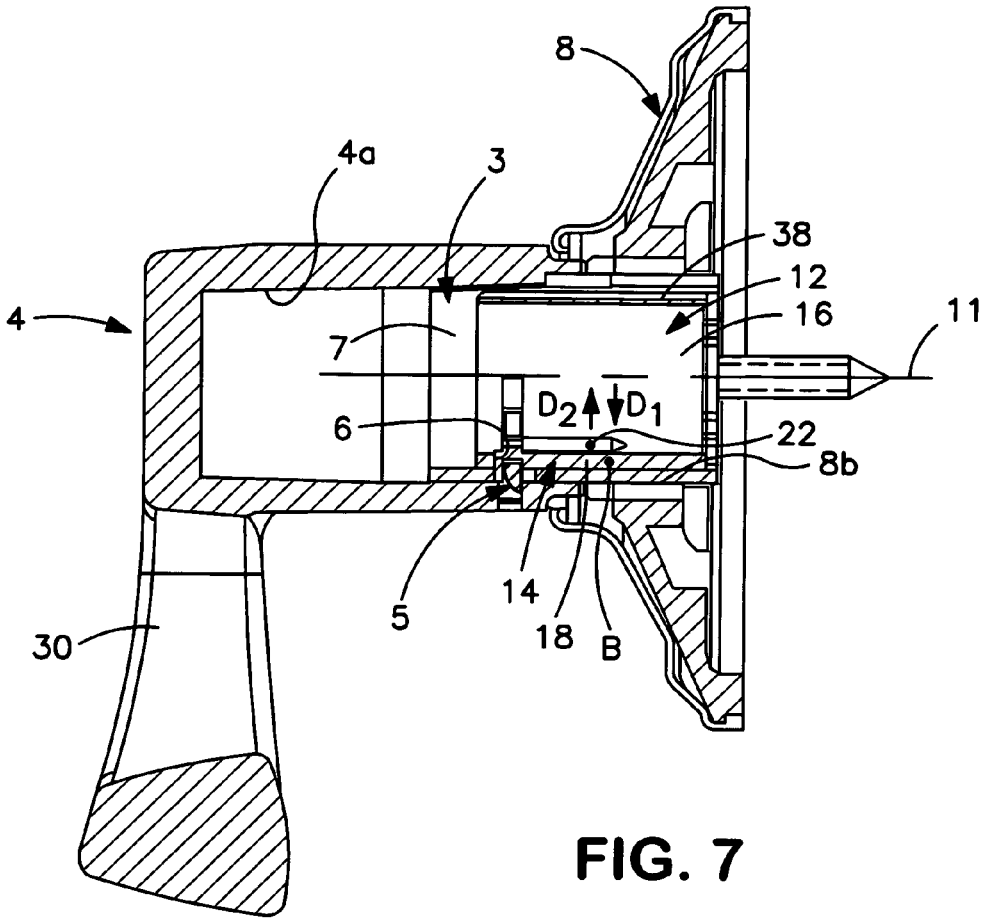
FIG. 7 is an axial cross-sectional view through line 7—7 of FIG. 6.
Figure 8:
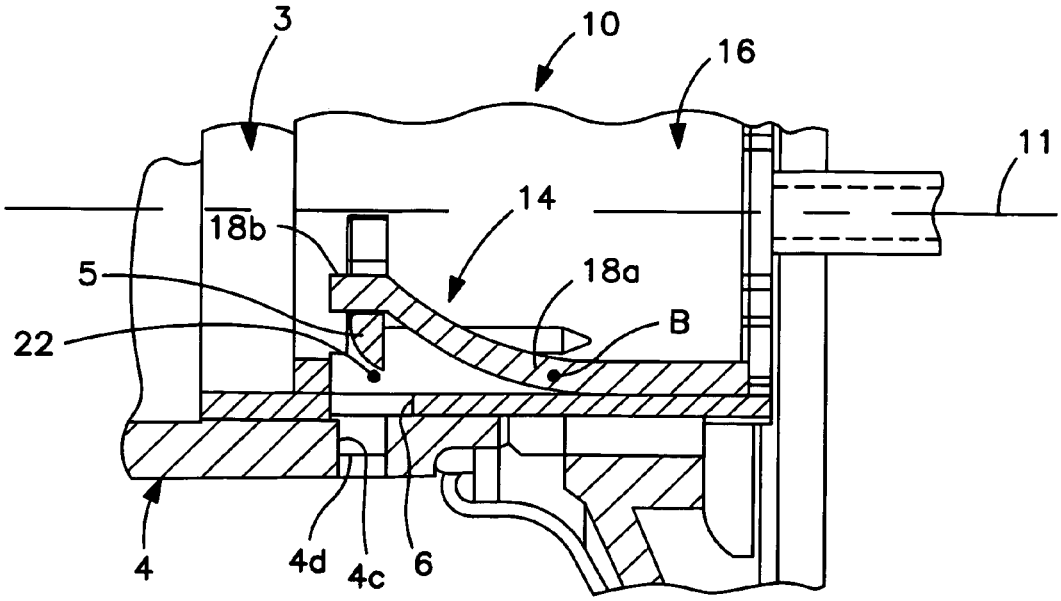
FIG. 8 is a broken-away, greatly enlarged portion of FIG. 7.
Figure 9:
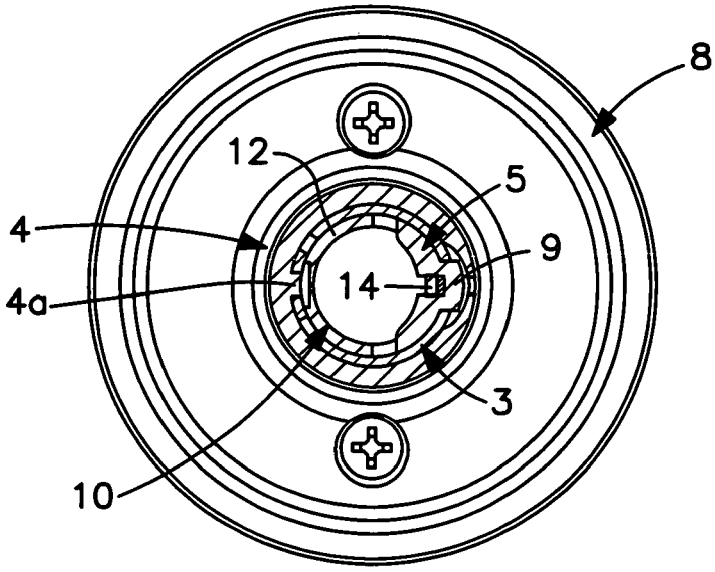
FIG. 9 is a radial cross-sectional view through line 9—9 of FIG. 6.
Figure 10:
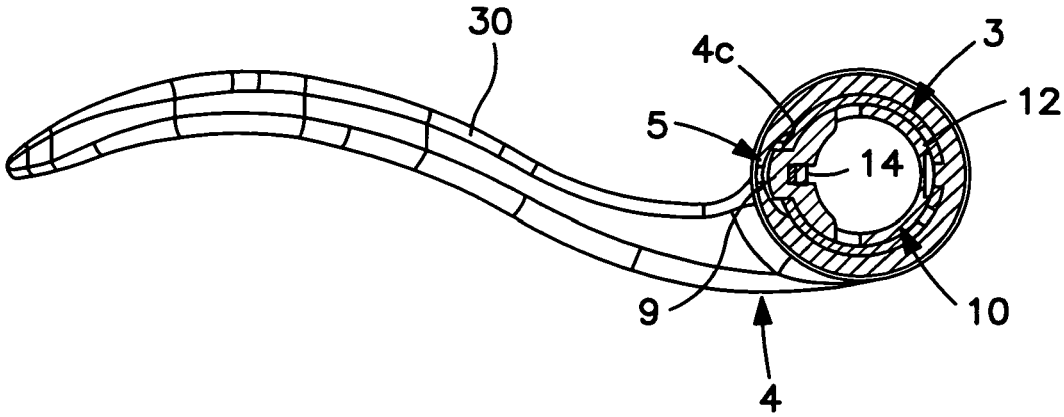
FIG. 10 is a radial cross-sectional view through line 10—10 of FIG. 6.
Figure 11A:
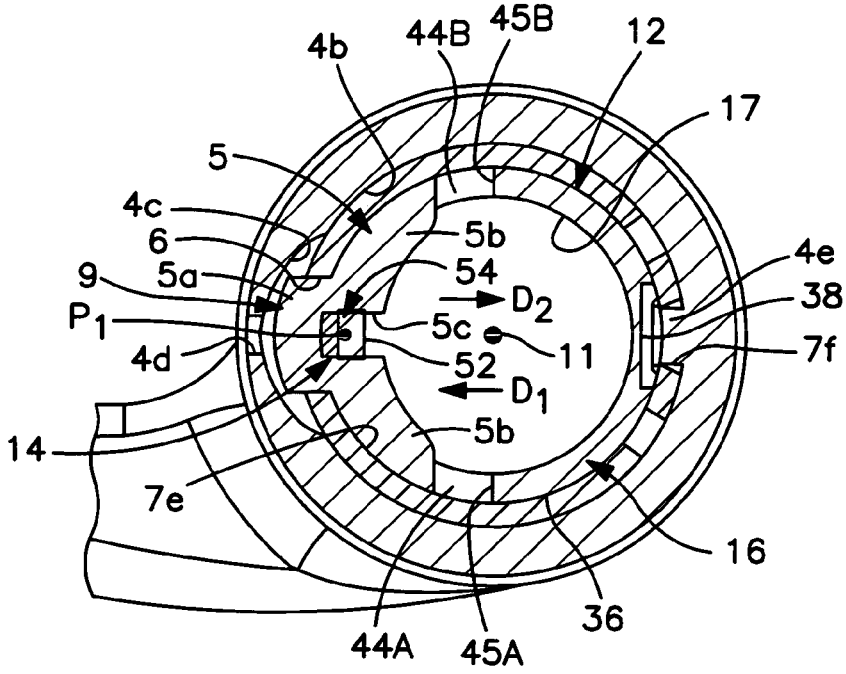
FIGS. 11A and 11B, collectively also referred to herein as FIG. 11, are two broken-away, enlarged views of the FIG. 10, showing first and second positions of a holder of the handle catch retainer.
Figure 11B:
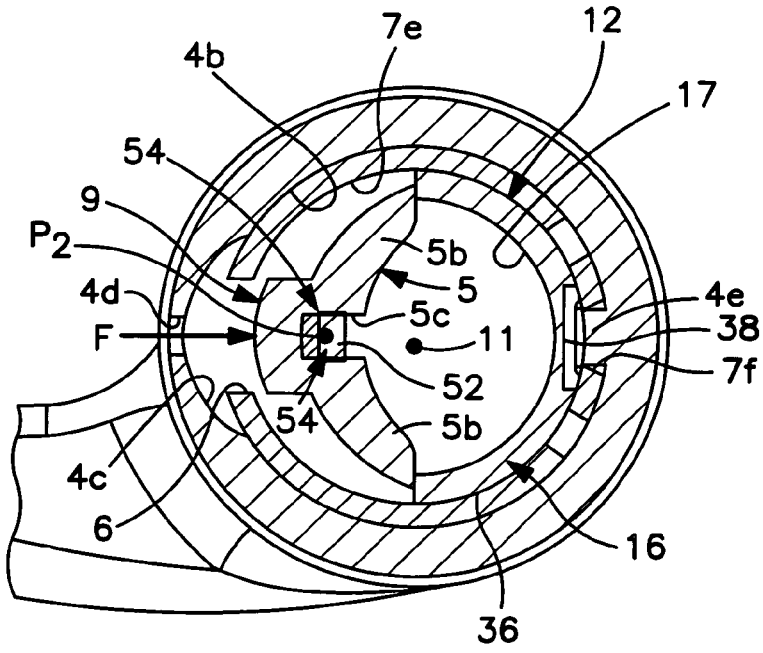

Referring now to the drawings in detail, wherein like numbers are used to indicate like elements throughout, there is shown in FIGS. 3–11 a presently preferred embodiment of a handle catch retainer 10 for a handle assembly 1 of a door 2, the handle assembly 1 including an inner support member 3 coupled with the door 2 and a handle 4 disposed at least partially about the support member 3, the catch 5 being configured to couple the handle 4 with the support member 3. The retainer 10 basically comprises a base 12 disposeable within the support member 3 and a holder 14 connected with the base 12. The holder 14 is configured to support the catch 5 and is moveable between first and second positions $P_1$, $P_2$ with respect to the base 12, as best shown in FIGS. 7, 8 and 11. As such, when the base 12 is disposed within the support member 3, the catch 5 is supported by the holder 14 and the handle 4 is disposed about the support member 3, the catch 5 is engageable with the handle 4 when the holder 14 is at the first position $P_1$ (FIGS. 7 and 11A) and the catch 5 is nonengageable with the handle 4 when the holder 14 is at the second position $P_2$ (FIGS. 8 and 11B).

More specifically, the holder 14 is displaceable from the second position $P_2$ to the first position $P_1$ to displace the catch 5 into engagement with the handle 4 and is alternatively displaceable from the first position $P_1$ to the second position $P_2$ to displace the catch 5 out of engagement with the handle 4. Specifically, the holder 14 and the catch 5 move in generally radial directions $D_1$, $D_2$ away from and alternatively toward, respectively, a retainer axis 11, as discussed below. Further, the retainer 10 is configured such that the holder 14 is generally biased toward the first position $P_1$, and away from the retainer axis 11, preferably by means of elastic material forces as discussed below, so at the maintain the handle 4 coupled with the support member 3. Furthermore, the catch 5 is mountable on the holder 14 when the base 12 is disposed externally of the support member 3 such that when the base 12 is installed within the support member 3, the catch 5 is positioned for engagement with the handle 4.

Preferably, the support member 3 includes an opening 6 sized to receive at least a portion of the catch 5; in other words, the catch 5 is disposeable within the support member opening 6 so that a portion of the catch 5 is engageable with the handle 4 when the handle 4 is disposed about the support member 3. The retainer holder 14 preferably has an attachment section 15 configured to mount the catch 5 to the retainer 10 and the retainer 10 is preferably formed such that when the base 12 is disposed within the support member 3, the holder attachment section 15 is disposed generally adjacent to the support member opening 6. As such, the catch 5 is extendable through the support member opening 6 to engage with the handle 4, as described in further detail below.

Figure 3:
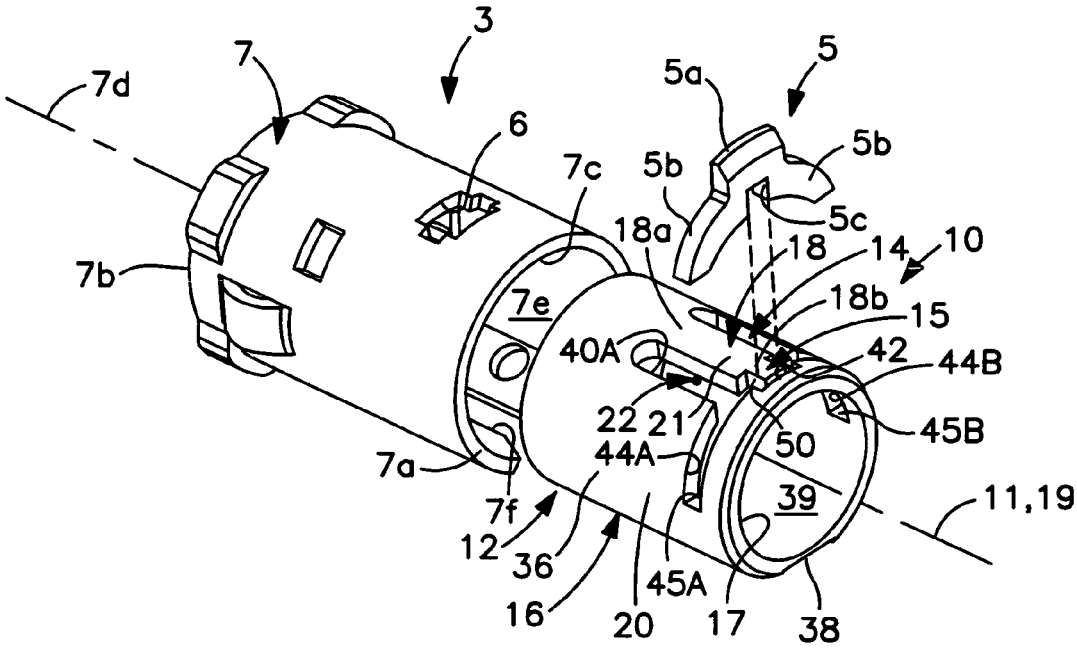
FIG. 3 is an exploded perspective view of a handle catch retainer in accordance with the present invention, shown located externally of a handle assembly support member.
Figure 4:
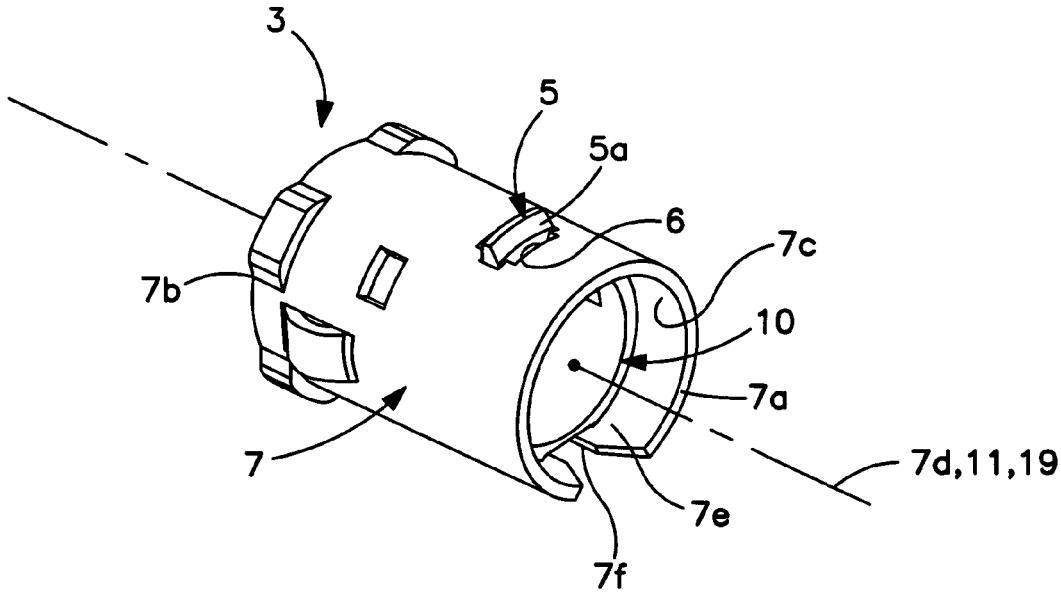
FIG. 4 is a perspective view of the handle catch retainer, shown disposed within the inner support member.

Further, the base 12 includes a generally tubular body 16 with a central bore 17 and the holder 14 includes an elongated body 18 having first and second ends 18*a*, 18*b*, respectively. The holder body first end 18*a* is connected with the base tubular body 16 and the holder second end 18*b* is configured to support the catch 5, thus providing the holder attachment section 15. The base tubular body 16 is disposeable within the support member 3 and has a central axis 19 providing the retainer axis 11, an enclosed sidewall 20 extending circumferentially about the axis 19, and an opening 22 extending through the sidewall 20. The holder body 18 is at least partially disposeable within the sidewall opening 22 so as to extend generally parallel with respect to the body axis 19, as shown in FIG. 3. Most preferably, the first end 18*a* of the holder elongated body 18 is integrally formed with the base tubular body 16 such that the retainer 10 is generally of one-piece construction. In other words, the retainer 10 is primarily formed of the generally tubular body 16, with the holder 14 being provided by a portion of the body 16 itself.

More specifically, the holder 14 is preferably provided by an elongated section 21 of the body sidewall 20 that is disposeable (and generally disposed) within the opening 22, as best shown in FIG. 3, the elongated section 21 having a first end attached with a remainder of the sidewall 20 and a second end configured to support the catch 5 (i.e., forming the attachment section 15). Thus, the holder elongated section 21 is preferably formed or constructed by molding, cutting or otherwise providing the opening 22 through the body tubular body sidewall 20. Further, the preferred one-piece retainer 10 is preferably formed of either a cast metallic material or a molded polymeric material.

Alternatively, the holder elongated body 18 may be formed as a separate elongated bar, beam or any other appropriate mechanical member connected to the base body 16 by any appropriate means, for example by a friction fit, an adhesive, a separate connector/fastener, etc. (none depicted). In such alternative constructions, the catch retainer 10 of the present invention is thus formed of two or more pieces/components.

With the preferred, one-piece retainer construction, the holder elongated body 18 is bendable with respect to the tubular body 16 so as to displace the holder 14 between the first and second positions $P_1$, $P_2$, as depicted in FIGS. 7, 8, 11A and 11B. In other words, a force F applied to the holder body 18 (e.g., by a tool or assemblers hand) causes the holder body 18 to pivotally displace generally about an axis B (FIGS. 7 and 8) through the first body end 18*a*, i.e., to "bend" with respect to the base body 12, so as to displace the holder 14 (and thus the catch 5) from the first position $P_1$ to the second position $P_2$. When the force F is removed, the holder body 18 deflects or "springs back" to displace the holder 14 from the second position $P_2$ to the first position $P_1$. Thus, the holder 14 is biased toward the first position $P_1$ by elastic material stresses or forces and physically behaves generally in the manner of a cantilever beam undergoing the application and removal of bending stresses. However, with an alternative construction, the retainer 10 may be provided with a separate device, such as a spring, to bias the holder 12 toward the first position $P_1$. Having described the basic elements of the present invention, these and other aspects of the present handle catch retainer 10 are described in greater detail below.

Referring to FIGS. 5–7, the handle catch retainer 10 may be used with a handle assembly 1 that further includes a latch (not shown) engageable with a door frame (not shown) and a retractor (not shown) configured to displace the latch. With such a handle assembly 1, the support member 3 is rotatably coupled with the door 2 (FIG. 5) and operatively connected with the retractor such that rotation of the support member 3 retracts the latch. Alternatively, the handle assembly 1 may include a separate component, such as a spindle (not shown) extending through the support member and connected with the handle 4, such that rotation of the handle 4 and spindle operates the retractor. Alternatively, the support member 3 may be linearly displaceably connected with the door 2, such as when incorporated into a handle 4 configured as a push bar assembly (not shown). Further, in another preferred application, the support member 3 may be immovably connected with the door 2, such as for example when used with a handle assembly 2 lacking a retractor and latch (e.g., a "dummy knob").

Referring now to FIGS. 3, 4, 7 and 9–11, the support member 3 is formed as a generally circular tube 7 connectable with the door 2 and configured to receive the retainer 10. The support tube 7 has an outer end 7*a*, an inner end 7*b*, a bore 7*c* extending between the ends 7*a*, 7*b*, a central axis 7*d* extending through the bore 7*c*, and an inner circumferential surface 7*e* bounding the bore 7*c*. Preferably, the tube 7 also has an axially-extending slotted opening or slot 7*f* sized to receive a lug portion 4*b* of the handle 4, as described below. The retainer tubular body 16 is insertable through the open, outer end 7*a* of the tube 7 and slidable within the bore 7*c* along the central axis 7*d*, so as to thereby install the retainer 10 within the support member 3. As best shown in FIG. 7, the inner end 7*b* is preferably disposeable within an opening 8*a* of a handle base member 8, preferably of the type commonly referred to as a "rose" 8 (FIGS. 5–7 and 9), mounted to the door 2. Alternatively, the support member 3 may be disposed within an opening of another type of support member or within an opening 2*a* formed within the door 2 itself, or otherwise connected with the door 2 in any other appropriate manner (no alternatives depicted).

Referring to FIGS. 5–7 and 9–11, the handle 4 preferably has a central bore 4*a* sized to fit about or over the support member outer end 7*a*, such that when the retainer 10 is assembled in the support member 3, at least the holder attachment section 15 (and thus the catch 5) are disposed within the handle bore 4*a*. As best shown in FIGS. 9 and 10, the handle 4 also has a lug portion 4*b* extending radially into the bore 4*a* and configured to engage with the slotted opening 7*f* of the preferred support member 3 to properly position or orient the handle 4 with respect to the support member 3. Further, the handle 4 also includes an engagement recess 4*c* extending radially outwardly from the bore 4*a* and sized to receive a lug 9 of the preferred catch 5 so as to couple the handle 4 with the inner support member 3, as discussed above and in further detail below. Additionally, the handle 4 also has an access opening 4*d* extending radially from the handle outer surface into the engagement recess 4*c*, which permits a tool to be inserted therethrough to contact the catch 5 and apply a force F, as discussed above. Furthermore, the catch retainer 10 may be used with any appropriate type of handle 4, such as for example, a lever 30 (as depicted), a knob (not shown), a push-bar (not shown), etc.

Referring to FIGS. 3, 4 and 9–11, the catch 5 is preferably generally arcuate-shaped and includes a central, engagement section 5*a* proving a coupling lug 9 and a pair of leg portions or legs 5*b*. The coupling lug 9 is disposeable within the support member opening 6 and is disposeable within the handle engagement recess 4*c* when the holder 14 is at the first position $P_1$, such the handle 4 is thereby coupled with the support member 3. Further, the legs 5*b* are disposeable against the inner circumferential surface 7*e* of the support member 3 so as to limit the movement of the catch 5 in the first direction $D_1$ (i.e., away from the retainer axis 11) and thereby define the first position $P_1$ of the retainer holder 14. Furthermore, an attachment recess 5*c* extends into the central section 5*a* and is engaged by an attachment lug 54 of the preferred holder 14, as discussed below, so as to mount the catch 5 onto the holder 14.

Referring now to FIGS. 3, 4 and 8–11, the tubular body 16 of the retainer base 12 is preferably generally circular, i.e., formed so as to have generally circular cross sections in planes extending perpendicularly through the axis 19. Alternatively, the tubular body 16 may have any appropriate shape, such as generally rectangular, generally elliptical or ovular, etc., as long as the retainer body 16 is disposeable within the support member 3 and capable of positioning the catch as generally described herein. The preferred tubular body 16 has an outer surface 36 extending generally circumferentially about the axis, with a flattened section or flat 38 extending generally parallel with respect to the axis 19. The flat 38 provides clearance for the handle lug 4*a* and functions as an index for properly positioning the retainer 10 within the support member 3. Further, the tubular body 16 also has an inner circumferential surface 39 bounding the body bore 17.

Furthermore, the base primary opening 22 (as discussed above) includes two axially extending sections 40A, 40B and a radially extending section 42 connecting the axial sections 40A, 40B, thereby defining the holder 14 as discussed above and in further detail below. The tubular body 16 also preferably has two clearance slotted openings 44A, 44B extending through the sidewall 20 and each extending radially from a separate one of the primary opening axial sections 40A, 40B. The body clearance openings 44A, 44B each provide clearance for a separate leg 5*b* of the catch 5 and form stop sections 45A, 45B, respectively in the base 12. The stop sections 45A, 45B are contactable by the outer ends of the legs 5 to limit the movement of the catch 5 in a direction $D_2$ toward the retainer axis 11.

Referring to FIGS. 3, 7 and 9–11, the holder body 18 preferably has an inwardly stepped or narrower portion 50 of the sidewall section 21 at the second end 21*b* and a rectangular projection extending radially inwardly from the stepped portion 50. The stepped portion 50 and the projection 52 form an attachment lug 54 sized to fit within the catch attachment recess 5*c* with a friction fit, so as to mount or connect the catch 5 with the retainer 10. Specifically, the catch 5 is pushed onto the holder 14 externally from the retainer 10 such that holder attachment lug 54 enters the catch recess 5*c*, until the attachment lug 54 is disposed against the catch central section 5*a*. Although the lug structure is preferred, the catch 5 and/or the holder 14 may be formed such that the catch 5 is mounted to the retainer 10 in any other appropriate manner, such as for example by means of an adhesive or a fastener (e.g., a screw, a rivet, etc.).

Figure 12:
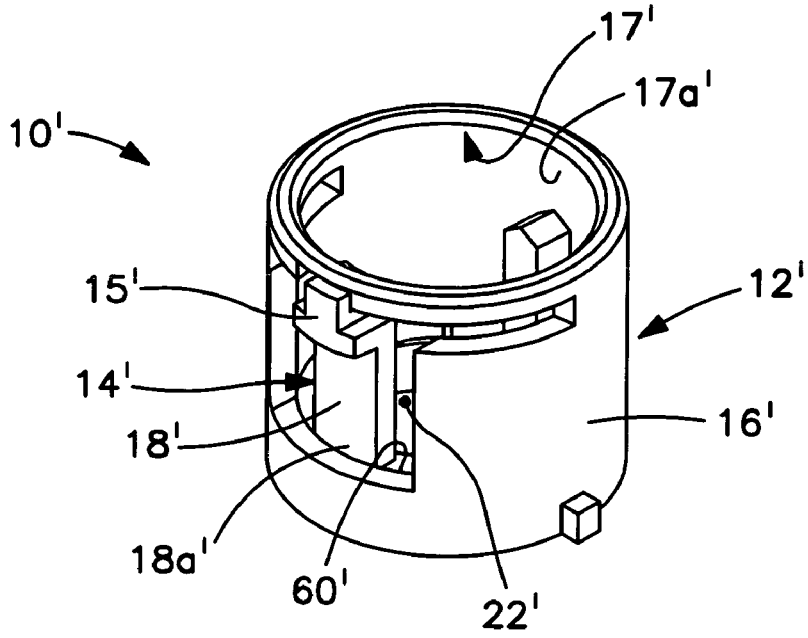
FIG. 12 is a perspective view of an alternative construction of the handle retainer in accordance with the present invention.
Figure 13:
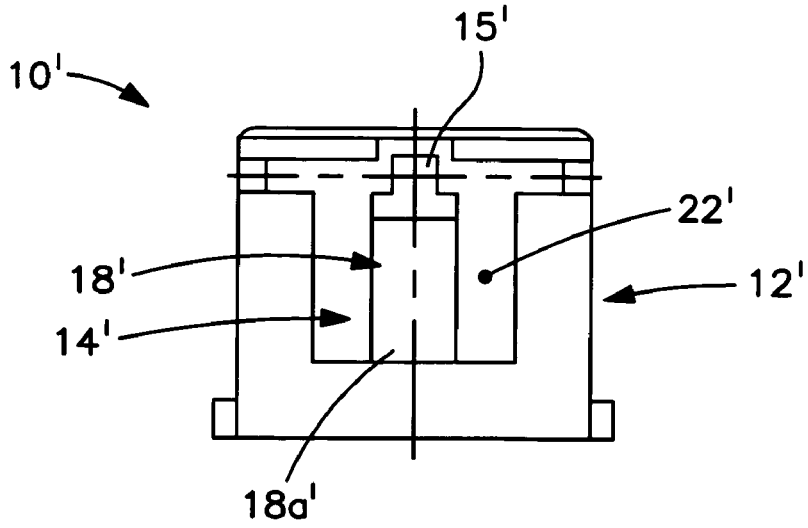
FIG. 13 is a side elevational view of the alternative construction handle catch retainer.

Referring to FIGS. 12 and 13, an alternative construction of the retainer 10' is generally similar to the preferred construction discussed above and depicted in FIGS. 3–11, with the following primary differences. As with the first construction, the retainer 10' includes a base 14' formed of a tubular body 16' with an opening 22' and a holder 14' formed of an elongated body 18' with a first end 18*a'* integrally formed with the base body 16'. However, the tubular body bore 17' has a counterbore section 17*a'* forming a shoulder 60' and the first end 18*a'* of the holder elongated body 18' is integrally formed with a base shoulder 60', as opposed to being formed from a section of the sidewall 20'. Further, the holder attachment section 15' is offset radially outwardly from a remainder of the elongated body 18'. As such, the holder 14' remains generally disposed within the body bore 17' and only the attachment section 15' is disposeable within the base primary opening 22'.

It is apparent that the catch retainer 10 or 10' of the present invention is advantageous over previously known catch retainer devices. With the present invention, the catch 5 is merely assembled onto the holder 14, 14' by pushing the catch central section 5*a* onto the holder attachment section 15 such that the attachment lug 54 enters the catch attachment recess 5*c*, thereby mounting the catch onto the retainer.

Figure 1:
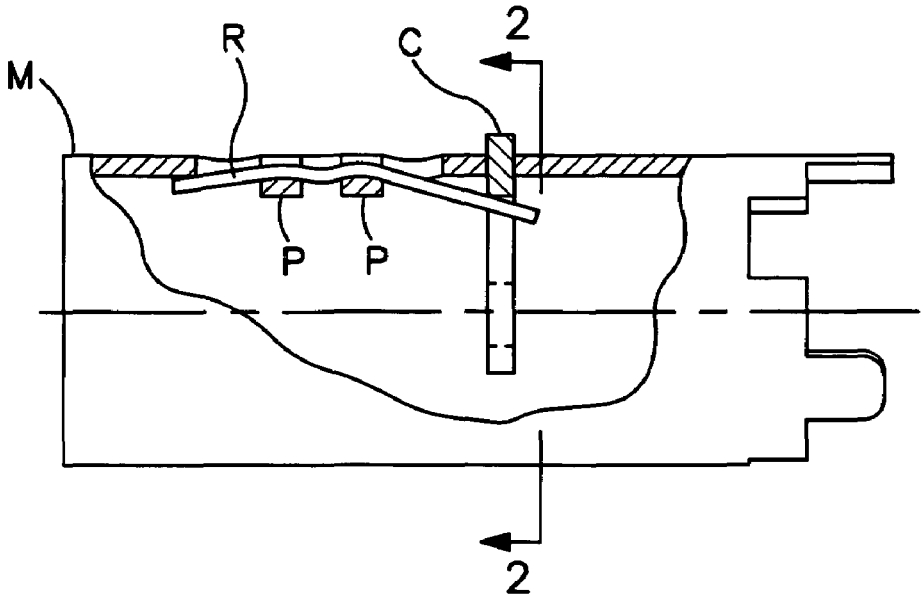
FIG. 1 PRIOR ART
FIG. 1 is a perspective view of a previously known catch retainer, shown disposed within a handle assembly inner support member.
Figure 2:
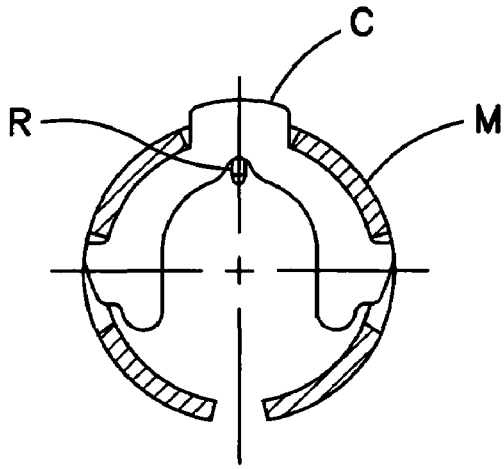
FIG. 2 PRIOR ART
FIG. 2 is a view through line 2—2 of FIG. 1.

Then, the holder base body 16 is slided into the support member bore 7*c* until the holder 14 is so located to push the catch 5 into the support member opening 6, thereby locating the catch 5 for engagement with the handle 4. Such an assembly process is much easier to accomplish than that used to fabricate the device depicted in FIGS. 1 and 2, which required slidably fitting the elongated retainer R into the support member connective portions P, then bending the retainer R and holding the retainer R in a displaced position while assembling the catch onto the retainer R.

It will be appreciated by those skilled in the art that changes could be made to the embodiments or constructions described above without departing from the broad inventive concept thereof. For example, the retainer 10 may be formed of two or more connected pieces as opposed to one-piece construction, the retainer base 12 may be formed as a generally solid cylinder as opposed to a tube, the holder 14 may be formed as an elongated bar, etc (none shown). It is understood, therefore, that this invention is not limited to the particular embodiments or constructions disclosed, but it is intended to cover modifications within the spirit and scope of the present invention as generally defined in the appended claims.

We claim:

1. A handle catch retainer for a door handle assembly, the handle assembly including an inner support member coupled with the door, a handle disposed at least partially about the support member, and a catch configured to couple the handle with the support member, the retainer comprising:

a base disposeable within the support member and including a generally tubular body, the base tubular body having a central longitudinal axis, an enclosed sidewall extending circumferentially about the axis and an opening extending through the sidewall; and a holder connected with the base, configured to support the catch, and moveable between first and second positions with respect to the base such that the catch is engageable with the handle when the holder is at the first position and the catch is nonengageable with the handle when the holder is at the second position, the retainer being configured so that the holder is generally biased toward the first position, the holder including an elongated body having a first end connected with the tubular body and a second end configured to support the catch, the holder body being disposeable within the sidewall opening so as to extend generally parallel with respect to the tubular body axis.

2. The handle catch retainer as recited in claim 1 wherein the handle assembly support member includes an opening, the support member opening being sized to receive at least a portion of the catch, the holder has an attachment section configured to mount the catch to the retainer, and the retainer is formed such that when the base is disposed within the support member, the holder attachment section is disposed generally adjacent to the support member opening such that the catch is extendable through the support member opening to engage with the handle.

3. The handle catch retainer as recited in claim 1 wherein the support member includes an opening and the catch is disposeable within the support member opening such that a portion of the catch is engageable with the handle when the handle is disposed on the support member.

4. The handle catch retainer as recited in claim 1 wherein the door handle assembly further includes a latch engageable with a door frame and a retractor configured to displace the latch, the support member being rotatably coupled with the door and operatively connected with the retractor such that rotation of the support member retracts the latch.

5. The handle catch retainer as recited in claim 1 wherein the support member is one of immovably connected with the door, rotatably connected with the door, and linearly displaceably connected with the door.

6. The handle catch retainer as recited in claim 1 wherein the retainer includes a generally tubular body providing the base and the holder such that the base and holder are integrally formed.

7. The handle catch retainer as recited in claim 1 wherein the handle is one of a knob and a lever.

8. The handle catch retainer as recited in claim 1 wherein the holder is displaceable from the second position to the first position to displace the catch into engagement with the handle and is alternatively displaceable from the first position to the second position to displace the catch out of engagement with the handle.

9. The handle catch retainer as recited in claim 1 wherein the catch is mountable on the holder when the base is disposed externally of the support member such that when the base is installed within the support member, the catch is positioned for engagement with the handle.

10. The handle catch retainer as recited in claim 1.

11. The handle catch retainer as recited in claim 10 wherein the elongated body is bendable with respect to the tubular body so as to displace the holder between the first and second positions, the holder being biased toward the first position by material stress.

12. The handle catch retainer as recited in claim 10 wherein the retainer is formed of one of a cast metallic material and a molded polymeric material.

13. The handle catch retainer as recited in claim 1 wherein the support member is formed as a generally circular tube and the retainer includes a generally tubular body providing the base and the holder, the tubular body being disposeable within the support member tube.

14. The handle catch retainer as recited in claim 13 wherein the support member tube has an open end and a central axis, and the tubular body is insertable through the open end and slidable along the central axis to install the retainer within the support member.

15. A handle catch retainer for a door handle assembly, the handle assembly including a support member coupled with a door, a handle disposed at least partially about the support member, and a catch configured to couple the handle with the support member, the retainer comprising:

a generally tubular body disposeable within the support member and having a portion providing a holder configured to support the catch, the holder being movable between a first position at which the catch is engageable with the handle and a second position at which the catch is nonengageable with the handle, the retainer being configured such that the holder is generally biased toward the first position;

wherein the tubular body has a generally enclosed sidewall with an opening and the holder is provided by an elongated section of the sidewall disposeable within the opening, the elongated section having a first end connected with a remainder of the sidewall and a second end configured to support the catch.

16. The handle catch retainer as recited in claim 15 wherein the handle assembly support member includes an opening, the support member opening being sized to receive at least a portion of the catch, the holder has an attachment section configured to mount the catch to the retainer, and the retainer is formed such that when the tubular body is disposed within the support member, the holder attachment section is disposed generally adjacent to the support member opening such that the catch is extendable through the support member opening to engage with the handle.

17. A handle catch retainer for a door handle assembly, the handle assembly including a support member coupled with a door, a handle disposed at least partially about the support member, and a catch configured to couple the handle with the support member, the retainer comprising:

a generally tubular body disposeable within the support member and having a portion providing a holder configured to support the catch, the holder being movable between a first position at which the catch is engageable with the handle and a second position at which the catch is nonengageable with the handle, the retainer being configured such that the holder is generally biased toward the first position;

wherein the handle assembly support member includes an opening, the support member opening being sized to receive at least a portion of the catch, the holder has an attachment section configured to mount the catch to the retainer, and the retainer is formed such that when the tubular body is disposed within the support member, the holder attachment section is disposed generally adjacent to the support member opening such that the catch is extendable through the support member opening to engage with the handle.

* * * * *